US008261886B2

(12) United States Patent
Kigawa et al.

(10) Patent No.: US 8,261,886 B2
(45) Date of Patent: Sep. 11, 2012

(54) SAFETY DEVICE FOR ELEVATOR AND ROPE SLIP DETECTION METHOD

(75) Inventors: Hiroshi Kigawa, Tokyo (JP); Naoyuki Maruyama, Tokyo (JP); Eiji Ando, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/440,029

(22) Filed: Apr. 5, 2012

(65) Prior Publication Data

US 2012/0193174 A1 Aug. 2, 2012

Related U.S. Application Data

(62) Division of application No. 12/595,866, filed as application No. PCT/JP2007/062484 on Jun. 21, 2007.

(51) Int. Cl.
*B66B 1/34* (2006.01)

(52) U.S. Cl. ..... 187/393; 187/288

(58) Field of Classification Search ..... 187/247, 187/277, 287, 288, 291, 303, 391–393
See application file for complete search history.

(56) References Cited

U.S. PATENT DOCUMENTS

| | | | | |
|---|---|---|---|---|
| 6,202,796 | B1 * | 3/2001 | Lee | 187/293 |
| 6,758,310 | B2 | 7/2004 | Muff et al. | |
| 6,860,367 | B1 * | 3/2005 | Ericson | 187/265 |
| 7,137,483 | B2 * | 11/2006 | Kato et al. | 187/251 |
| 7,344,003 | B2 * | 3/2008 | Kimura et al. | 187/256 |
| 7,669,697 | B2 * | 3/2010 | Ueda et al. | 187/391 |
| 2005/0269163 | A1 | 12/2005 | Angst | |
| 2006/0124399 | A1 | 6/2006 | Kugiya et al. | |
| 2010/0300813 | A1 * | 12/2010 | Kigawa et al. | 187/247 |

FOREIGN PATENT DOCUMENTS

| | | |
|---|---|---|
| DE | 232 897 A1 | 2/1986 |
| DE | 39 12 575 C2 | 5/1991 |
| EP | 1 749 780 A1 | 2/2007 |
| EP | 1 602 610 B1 | 4/2010 |
| JP | 52-123052 | 10/1977 |
| JP | 06-271264 | 9/1994 |
| JP | 7-33228 | 4/1995 |
| JP | 08-059126 | 3/1996 |
| JP | 9-40333 | 2/1997 |
| JP | 2002-173278 | 6/2002 |

(Continued)

OTHER PUBLICATIONS

Japanese Office Action issued Feb. 7, 2010, in Japanese Patent Application No. 2009-520207, 3 pages.

(Continued)

*Primary Examiner* — Anthony Salata
(74) *Attorney, Agent, or Firm* — Oblon, Spivak, McClelland, Maier & Neustadt, L.L.P.

(57) ABSTRACT

In a safety system for an elevator, slip detection means detects a slip between a drive sheave and a main rope. A safety gear is mounted to a car, the safety gear being electrically operated by an actuator to cause the car to make an emergency stop regardless of whether a running direction of the car is upward or downward. A safety gear controller cuts power supply to a hoisting machine motor and causes the safety gear to make a braking operation upon detection of the slip between the drive sheave and the main rope by the slip detection means.

1 Claim, 7 Drawing Sheets

FOREIGN PATENT DOCUMENTS

| | | | |
|---|---|---|---|
| JP | 2002-226151 | | 8/2002 |
| JP | 2004-010323 | | 1/2004 |
| JP | 2004-149231 | | 5/2004 |
| JP | 2004-231355 | | 8/2004 |
| JP | 2005-343696 | | 12/2005 |
| JP | 2007-031149 | | 2/2007 |
| JP | 2009215012 A | * | 9/2009 |
| WO | WO 03/008317 | | 1/2003 |
| WO | 03-045828 | | 6/2003 |
| WO | 2005-049468 | | 6/2005 |
| WO | 2008-099487 | | 8/2008 |

OTHER PUBLICATIONS

German Office Action issued Sep. 22, 2011, in German Patent Application No. 11 2007 003 542.0 (with English-language translation).

* cited by examiner

SAFETY DEVICE FOR ELEVATOR AND ROPE SLIP DETECTION METHOD

The present application is a divisional application of U.S. patent application Ser. No. 12/595,866, filed on Oct. 14, 2009, which is the National Stage of PCT/JP2007/062484 filed Jun. 21, 2007.

TECHNICAL FIELD

The present invention relates to a safety system for an elevator, which detects a slip between a drive sheave and a main rope to stop a car, and to a method of detecting a rope slip for an elevator, which is used for the safety system.

BACKGROUND ART

In a conventional emergency stop system for an elevator, an output from a tachogenerator for a main rope and an output from a tachogenerator for a drive sheave are compared with each other. If a difference is generated between the outputs, it is judged that a rope slip has occurred. Then, a command for gripping a governor rope is input to a governor rope stop device. When the governor rope is gripped by the governor rope stop device, a safety gear is operated to suddenly stop a car (for example, see Patent Document 1)

Patent Document 1: JP 2004-149231 A

DISCLOSURE OF THE INVENTION

Problem to be Solved by the Invention

In recent years, there has been an increasing need of a quick stop of the car in an emergency such as for measures to prevent passengers from being caught between a landing and an opening of the car when the car runs with a door open or an emergency stop of an elevator including a plurality of cars in the same hoistway. In the conventional emergency stop system for the elevator as described above, however, the governor rope is gripped after the rope slip is detected. Then, the safety gear is operated upon lowering of the car. Therefore, it takes a long time period to suddenly stop the car. Moreover, depending on a weight balance between the car and a counterweight, the car is sometimes lifted up. The conventional safety gear cannot cope with this situation, and hence the car stops while making the rope slip. Therefore, even in this case, it takes a long time period to suddenly stop the car.

The present invention is devised to solve the problems described above, and has an object of providing a safety system for an elevator, which is capable of immediately stopping a car upon detection of a rope slip, regardless of a state of a weight balance between the car and the counterweight, and a method of detecting the rope slip for the elevator, which is used for the safety system.

Means for Solving the Problems

A safety system for an elevator according to the present invention includes: slip detection means for detecting a slip between a drive sheave and a main rope; a safety gear mounted to a car, the safety gear being electrically operated by an actuator to cause the car to make an emergency stop regardless of whether a running direction of the car is upward or downward; and a safety gear controller for cutting power supply to a hoisting machine motor and causing the safety gear to make a braking operation upon detection of the slip between the drive sheave and the main rope by the slip detection means.

Further, a method of detecting a rope slip for an elevator according to the present invention includes: monitoring an acceleration signal obtained by converting an output from a drive sheave rotation detector for generating a signal according to rotation of a drive sheave into an acceleration when a brake operation command is issued from a travel controller for controlling a travel of a car; and detecting occurrence of a slip between the drive sheave and a main rope by detecting that a value of the acceleration signal exceeds a predetermined deceleration.

Further the method of detecting a rope slip for an elevator according to the present invention includes: monitoring a rate of reduction of a motor torque of a hoisting machine motor during normal running of a car; and detecting occurrence of a slip between a drive sheave and a main rope by detecting that the rate of reduction becomes larger than a predetermined value.

Further the method of detecting a rope slip for an elevator according to the present invention includes: monitoring a signal from a temperature measuring device for generating a signal according to a temperature of a surface of a drive sheave and a surface of a main rope, the surfaces being brought into contact with each other, to detect occurrence of a slip between the drive sheave and the main rope.

BEST MODE FOR CARRYING OUT THE INVENTION

Hereinafter, preferred embodiments of the present invention are described with reference to the drawings.

First Embodiment

Figure 1:
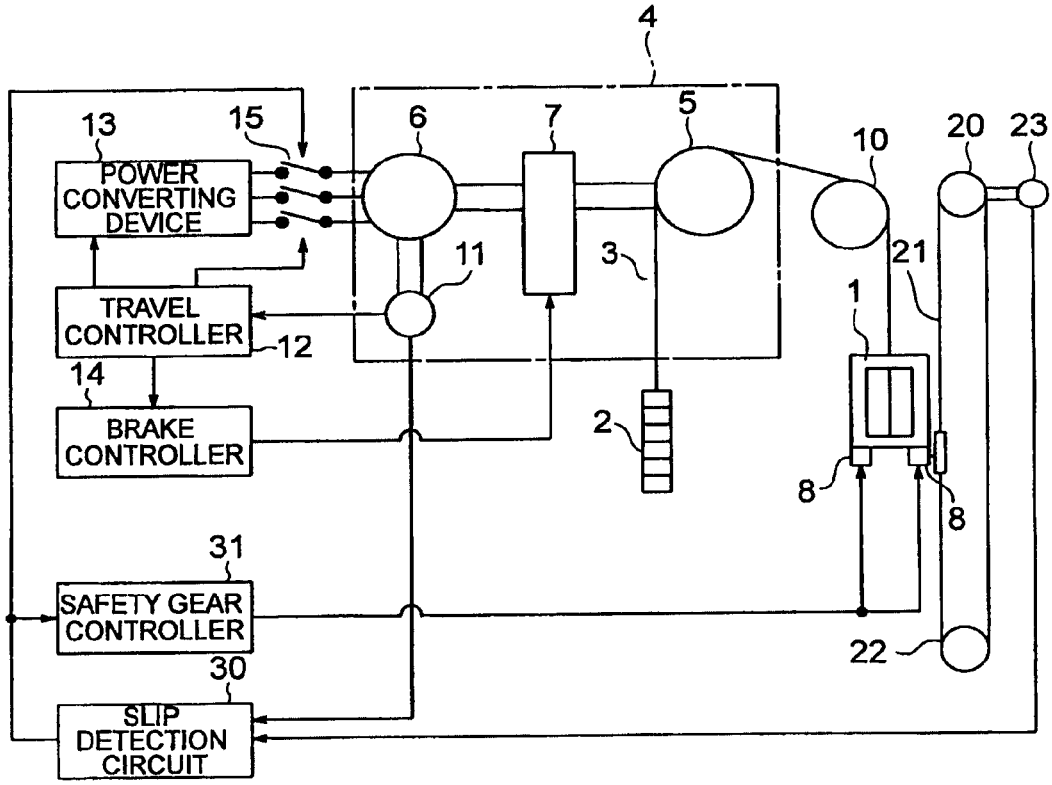
FIG. 1 is a configuration diagram illustrating an elevator apparatus according to a first embodiment of the present invention.

FIG. 1 is a configuration diagram illustrating an elevator apparatus according to a first embodiment of the present invention. In the drawing, a car 1 and a counterweight 2 are suspended in a hoistway by a main rope 3 corresponding to suspension means, and are raised and lowered in the hoistway by a driving force of a hoisting machine 4. In the hoistway, a pair of car guide rails 9 (FIG. 2) for guiding the raising and lowering of the car 1 and a pair of counterweight guide rails (not shown) for guiding the raising and lowering of the counterweight 2 are provided.

The hoisting machine 4 includes a drive sheave 5 around which the main rope 3 is looped, a hoisting machine motor 6 for rotating the drive sheave 5, and a hoisting machine brake 7 for braking the rotation of the drive sheave 5. Safety gears (vertical safety gears) 8 for gripping the car guide rails 9 to cause the car 1 to make an emergency stop are mounted to the car 1. The safety gears 8 are electrically operated by an actuator to cause the car 1 to make an emergency stop regardless of whether a running direction of the car 1 is upward or downward. In the vicinity of the drive sheave 5, a deflector sheave 10, around which the main rope 3 is looped, to be rotated by the movement of the main rope 3 is provided.

The hoisting machine motor 6 is provided with a drive sheave rotation detector 11 for generating a signal according to the rotation of a rotating shaft thereof, specifically, the rotation of the drive sheave 5. As the drive sheave rotation detector 11, for example, an encoder, a resolver, a tachogenerator, or the like is used.

A travel controller 12 causes the car 1 to run or stop in response to a call, and feeds command signals to a power converting device 13 and a brake controller 14 according to a signal obtained by converting an output from the drive sheave rotation detector 11 into a speed.

The power converting device 13 is, for example, an inverter, and feeds electric power to the hoisting machine motor 6 in response to the command from the travel controller 12. In this manner, the car 1 is operated.

In case of emergency braking with a high degree of urgency, the travel controller 12 opens a relay 15 between the power converting device 13 and the hoisting machine motor 6 to cut electricity to the hoisting machine motor 6 to stop the generation of a motor torque and issues an emergency stop signal to the brake controller 14.

The brake controller 14 controls the hoisting machine brake 7 in response to the command from the travel controller 12. Specifically, in normal running, upon reception of a start signal from the travel controller 12, the brake controller 14 releases the hoisting machine brake 7. When the car 1 is stopped at a stop floor, the brake controller 14 receives a stop signal from the travel controller 12 to cause the hoisting machine 7 to perform a braking operation to maintain a stationary state of the car 1. In case of an emergency stop, the hoisting machine brake 7 is caused to perform the braking operation regardless of the position of the car 1.

A governor sheave 20 is provided in an upper part of the hoistway. A governor rope 21 is looped around the governor sheave 20. Both ends of the governor rope 21 are connected to a safety gear operating mechanism (not shown) for operating the safety gears 8. A tension sheave 22 for applying a tension to the governor rope 21 is suspended at a lower end of the governor rope 21.

When the car 1 is raised or lowered, the governor rope 21 is cyclically moved to rotate the governor sheave 20. Therefore, the governor sheave 20 is rotated at a speed according to the speed of the car 1. The governor sheave 20 is provided with a flyweight (not shown) which is turned outward by a centrifugal force due to the rotation of the governor sheave 20. When the speed of the car 1 becomes equal to or higher than a preset speed, the governor rope 21 is fixed by means of the movement of the flyweight as a trigger. When the car 1 is lowered with the governor rope 21 fixed, the safety gear operating mechanism is mechanically operated to cause the safety gears 8 to operate.

A car operation detector 23 for generating a signal according to the rotation of the governor sheave 20, that is, a signal according to the movement of the car 1 is provided to the governor sheave 20. As the car operation detector 23, for example, an encoder, a resolver, a tachogenerator, or the like is used.

A slip detection circuit 30 compares a signal obtained by converting the output from the drive sheave rotation detector 11 into a speed and a signal obtained by converting the output from the car operation detector 23 into a speed and judges the occurrence of a slip (rope slip) between the main rope 3 and the drive sheave 5 when a difference between the signals is equal to or larger than a predetermined value. Slip detection means of the first embodiment includes the drive sheave rotation detector 11, the car operation detector 23, and the slip detection circuit 30.

Upon judgment of the occurrence of the rope slip, the slip detection circuit 30 opens the relay 15 to cut the electricity to the hoisting machine motor 6 independently of the travel controller 12 and also outputs a safety gear operation command to a safety gear controller 31. The safety gears 8 are capable of performing a braking operation either by the fixation of the governor rope 21 or by the control with the safety gear controller 31.

The functions of the travel controller 12, the brake controller 14, the slip detection circuit 30, and the safety gear controller 31 can be realized by calculation processing with at least one computer including a calculation processing section (CPU or the like), a storage section (ROM, RAM, hard disk, or the like), and a signal input/output section.

Figure 2:
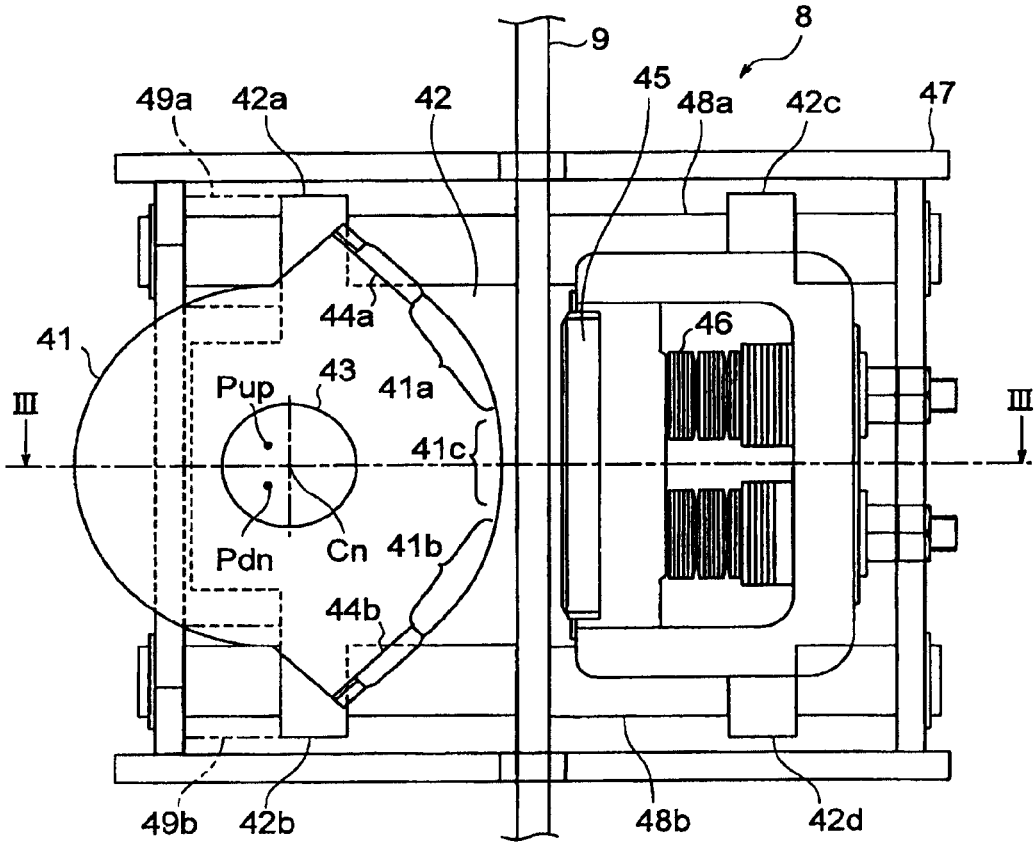
FIG. 2 is a configuration diagram illustrating one of safety gears illustrated in FIG. 1.
Figure 3:
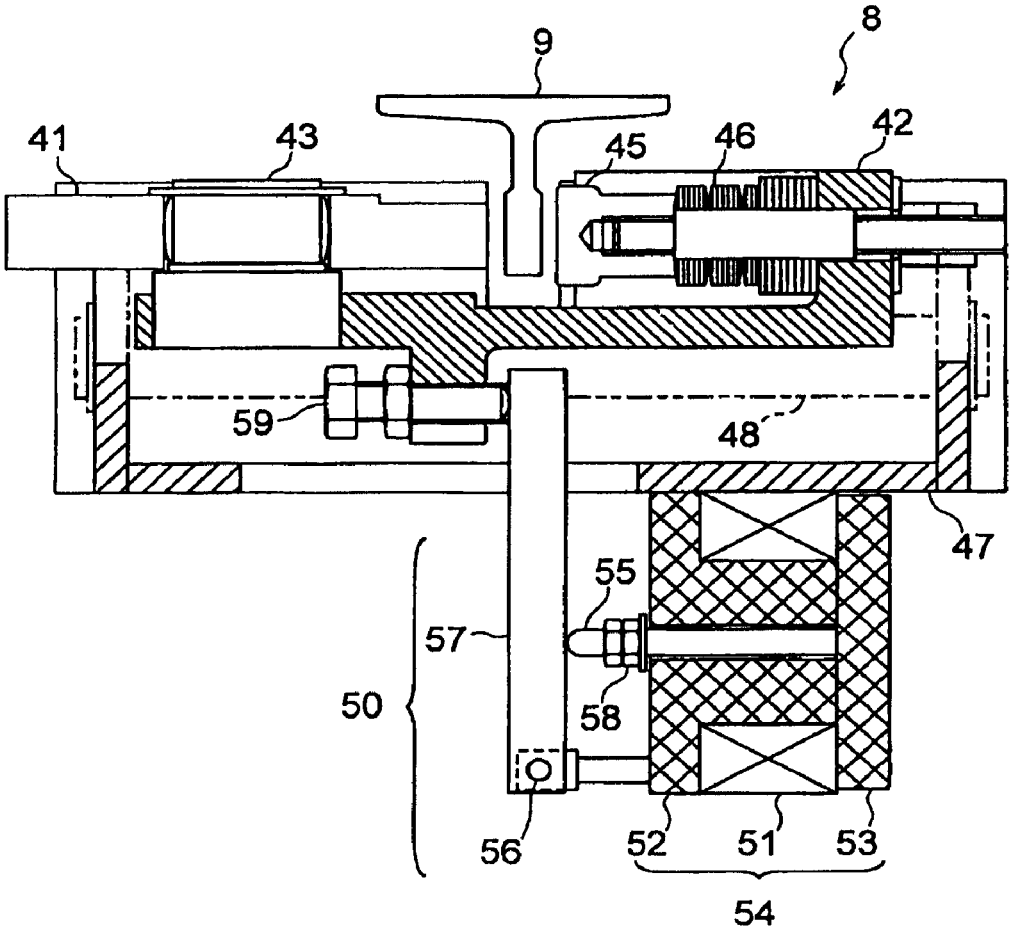
FIG. 3 is a sectional view taken along a line III-III of FIG. 2.

FIG. 2 is a configuration diagram illustrating one of the safety gears 8 illustrated in FIG. 1, and FIG. 3 is a sectional view taken along the line III-III of FIG. 2. A mounting frame 47 is mounted to the car 1. An upper guide rod 48*a* and a lower guide rod 48*b* are mounted to the mounting frame 47. The upper guide rod 48*a* and the lower guide rod 48*b* are horizontally provided in parallel to each other with a vertical distance therebetween.

A housing 42 is provided inside the mounting frame 47. Slide guides 42*a*, 42*b*, 42*c*, and 42*d* are provided to an upper part and a lower part of the housing 42. The upper guide rod 48*a* passes through the slide guides 42*a* and 42*c*, whereas the lower guide rod 48*b* passes through the slide guides 42*b* and 42*d*. As a result, the housing 42 is horizontally slidable along the guide rods 48*a* and 48*b* with respect to the mounting frame 47.

A movable rail stopper 41 is mounted to one side of the housing 42 with respect to the car guide rail 9 while a predetermined clearance from the car guide rail 9 is ensured. The movable rail stopper 41 is rotatably mounted to a main shaft 43 mounted to the housing 42.

In an outer peripheral portion of the movable rail stopper 41 on the car guide rail 9 side with respect to a center of rotation Cn, an upper cylindrical surface 41*a* having a position Pup which is offset upward from the center of rotation Cn as a center, a lower cylindrical surface 41*b* having a position Pdn which is offset downward from the center of rotation Cn as a center, and a rail contact portion 41*c* connecting the cylindrical surfaces 41*a* and 41*b* to each other are provided. An upper brake shoe 44*a* is provided to be adjacent to an upper end of the upper cylindrical surface 41*a*. Further, a lower brake shoe 44*b* is provided to be adjacent to a lower end of the lower cylindrical surface 41*b*.

The center Pup of the upper cylindrical surface 41*a* is situated close to a Y-axis in a second quadrant of an X-Y coordinate having the center Cn as a center, whereas the center Pdn of the lower cylindrical surface 41*b* is situated close to the Y-axis in a third quadrant.

A fixed rail stopper 45 is mounted to the other side of the housing 42 with respect to the car guide rail 9, ensuring a predetermined clearance from the car guide rail 9. The movable rail stopper 41 and the fixed rail stopper 45 are opposed to each other through the car guide rail 9. A pressure element 46 is provided on the side of the fixed rail stopper 45, which is opposite to the car guide rail 9. The pressure element 46 includes, for example, a plurality of disc springs, and is fixed to the housing 42.

A plurality of elastic elements 49*a* and 49*b* are provided between the slide guides 42*a* and 42*b* and a left end of the mounting frame 47, respectively. As the elastic elements 49*a* and 49*b*, for example, coil springs respectively surrounding the guide rods 48*a* and 48*b* are used.

A hold/release mechanism 50 (FIG. 3) for the elastic elements 49*a* and 49*b* is provided to the side of the mounting frame 47, which is opposite to the housing 42. A configuration of the hold/release mechanism 50 is as follows. Specifically, a fixed iron core 52 is fixed to the mounting frame 47. A coil 51 is incorporated into the fixed iron core 52. A movable iron core 53 is located at one end of the fixed iron core 52. The fixed iron core 52, the coil 51, and the movable iron core 53 constitute an electromagnetic magnet 54 serving as an actuator.

In the center of the movable iron core 53, a drawing pin 55 is fixed. The drawing pin 55 passes through the center of the fixed iron core 52. A plurality of adjustment nuts 58 are screwed to the drawing pin 55. By adjusting the positions of the adjustment nuts 58, a clearance between the movable iron core 53 and the fixed iron core 52 can be set to a predetermined value.

A holding lever 57, which is rockable through an intermediation of a rotation supporting pin 56, is coupled to the fixed iron core 52. A clearance distributing adjustment bolt 59 is screwed to the side of the housing 42, which is opposite to the car guide rail 9. A distal end of the holding lever 57 abuts against the clearance distributing adjustment bolt 59.

Normally, the electromagnetic magnet 54 is excited by the safety gear controller 31 to maintain a state where the movable iron core 53 is attracted to the fixed iron core 52. Therefore, the drawing pin 55 is maintained not to move in an axial direction, thereby regulating the rocking of the holding lever 57 in a clockwise direction of FIG. 3.

Moreover, the housing 42 is biased by the elastic elements 49*a* and 49*b* toward the side where the movable rail stopper 41 is brought into contact with the car guide rail 9. However, the clearance distribution adjustment bolt 59 attached to the housing 42 abuts against the holding lever 57, and hence the displacement of the housing 42 is regulated in a direction in which the movable rail stopper 41 is brought into contact with the car guide rail 9.

Here, a retention force of the electromagnetic magnet 54 is set to allow a force of preventing the rocking of the holding lever 57 by the drawing pin 55 to overcome a biasing force of the elastic elements 49*a* and 49*b* to the housing 42.

Upon input of the safety gear operation command to the safety gear controller 31, the coil 51 of the electromagnetic magnet 54 is de-energized by the safety gear controller 31. Then, the retention force of the electromagnetic magnet 54 disappears. As a result, the regulation of the displacement of the movable iron core 53 and the drawing pin 55 is cancelled. By the pressure force of the elastic elements 49*a* and 49*b*, the housing 42 is displaced in a right-hand direction of FIG. 2, whereas the holding lever 57 is rocked in a clockwise direction of FIG. 3.

When a rail contact portion 41*c* of the movable rail stopper 41 is caused to abut against the car guide rail 9 as a result of the displacement of the housing 42, the movable rail stopper 41 is rotated in a direction according to the running direction (upward or downward) of the car 1. For example, when the car 1 is lowered, the movable rail stopper 41 is rotated in a counterclockwise direction of FIG. 2.

When the movable rail stopper 41 is rotated in the counterclockwise direction, the center Pdn of the lower cylindrical surface 41*b* moves closer to the car guide rail 9. Therefore, the movable rail stopper 41 is displaced in a left-hand direction of FIG. 2 together with the housing 42 while the movable rail stopper 41 itself is in contact with the car guide rail 9. Then, when the movable rail stopper 41 further rotates, the fixed rail stopper 45 starts coming into contact with the car guide rail 9 to compress the pressure element 46.

After that, when the movable rail stopper 41 further rotates, the lower brake shoe 44*b* is brought into contact with the car guide rail 9 to be brought into a surface abutting state. At this time, the car guide rail 9 is held between the lower brake shoes 44*b* and the fixed rail stopper 45 with a predetermined pressure force of the pressure element 46. Therefore, the car 1 is decelerated to be stopped with a desired braking force.

When the car 1 is raised, the direction of rotation of the movable rail stopper 41 after the movable rail stopper 41 is brought into contact with the car guide rail 9 becomes the clockwise direction of FIG. 2. The subsequent operation is substantially the same as that performed when the car is lowered.

In the safety system for the elevator as described above, upon occurrence of the rope slip, the coil 51 of the electromagnetic magnet 54 is de-energized by the safety gear controller 31 to cause the safety gears 8 to perform the braking operation independently of the travel controller 12. Therefore, as compared with the case where the governor rope 21 is gripped for braking, the braking operation can be quickly started by the electric signal. As a result, an operation time period can be improved to be comparable to that of the hoisting machine brake 7. Moreover, regardless of whether the running direction of the car 1 is upward or downward, the braking can be effected by a single mechanism. Specifically, regardless of a state of a weight balance between the car 1 and the counterweight 2, the car 1 can be immediately stopped upon detection of the rope slip. Further, the safety gears 8 can be provided to the car 1 as in the case of a conventional safety gear. Therefore, an additional space for providing the safety gears is not required.

The slip detection circuit 30 may also compare a signal obtained by converting the output from the drive sheave rotation detector 11 into the displacement and a signal obtained by converting the output from the car operation detector 23 into the displacement and judge the occurrence of the slip between the main rope 3 and the drive sheave 5 when a difference between the signals is equal to or larger than a predetermined value.

Figure 4:
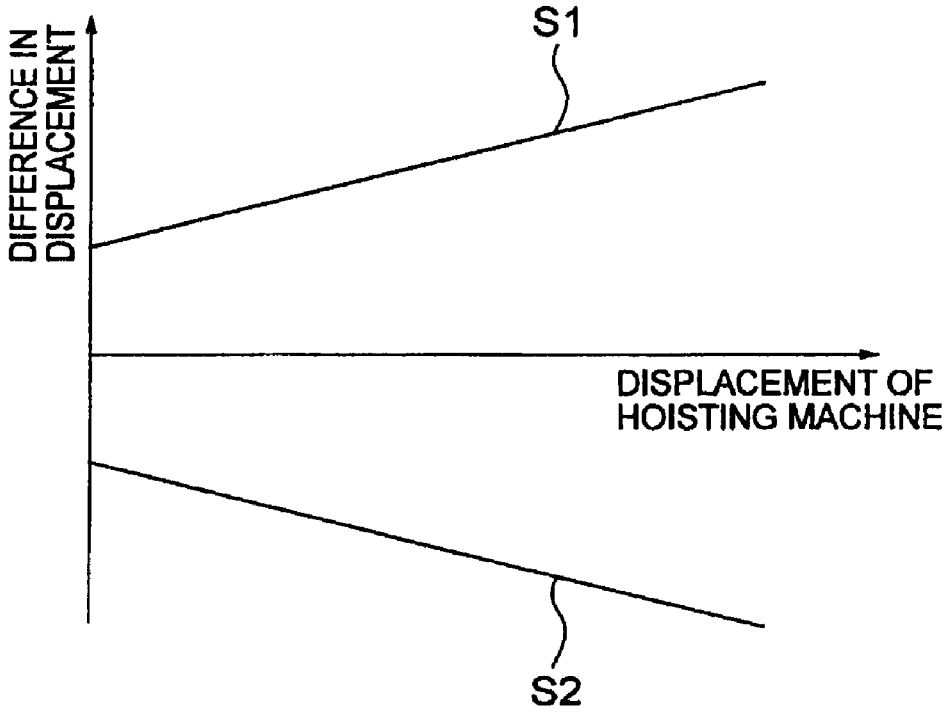
FIG. 4 is a graph showing an example of an upper-limit curve and a lower-limit curve of a difference in displacement, which are set for a slip detection circuit illustrated in FIG. 1.

Alternatively, the slip detection circuit 30 may have, in advance, an upper-limit curve 51 and a lower-limit curve S2 of a difference in displacement, which vary depending on a travel distance of the car 1, as illustrated in FIG. 4. In this case, a difference between the signal obtained by converting the output from the drive sheave rotation detector 11 into the displacement and the signal obtained by converting the output from the car operation detector 23 into the displacement is compared with the upper-limit curve S1 and the lower-limit curve S2. When the difference in displacement is larger than the upper-limit curve or is smaller than the lower-limit curve, it is judged that the slip has occurred between the main rope 3 and the drive sheave 5.

Second Embodiment

Figure 5:
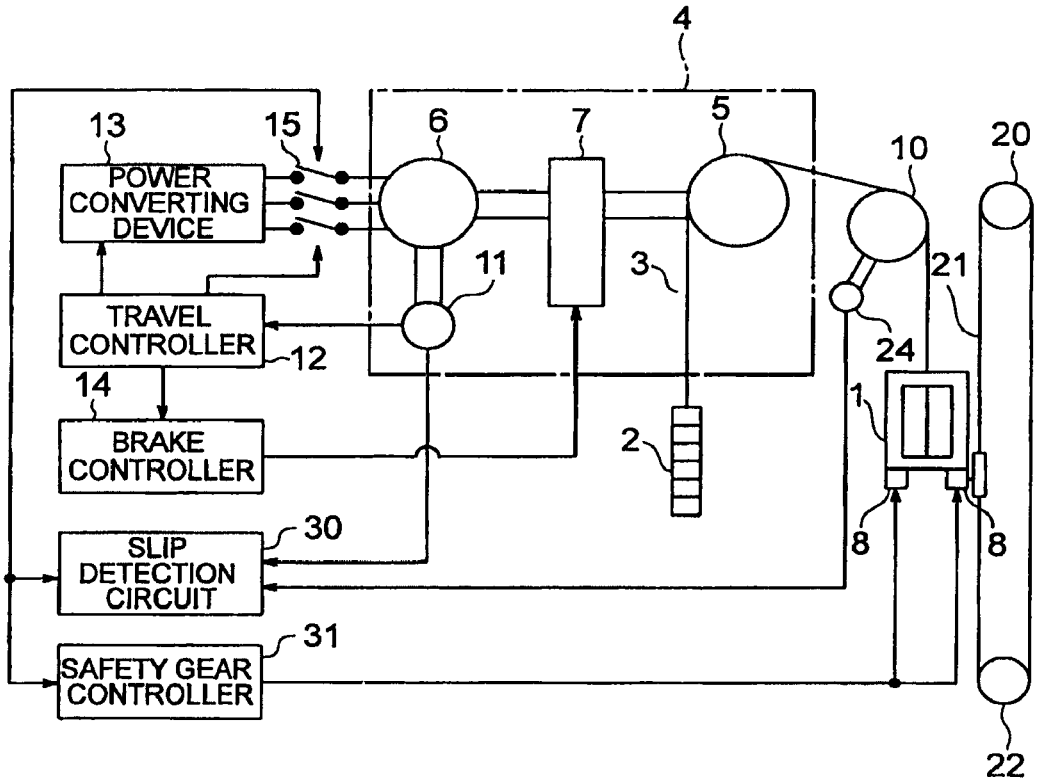
FIG. 5 is a configuration diagram illustrating an elevator apparatus according to a second embodiment of the present invention.

Next, FIG. 5 is a configuration diagram illustrating an elevator apparatus according to a second embodiment of the present invention. Although the car operation detector 23 is provided to the governor sheave 20 in the first embodiment, a car operation detector 24 is provided to the deflector sheave 10 in the second embodiment. The car operation detector 24 generates a signal according to the rotation of the deflector sheave 10, specifically, a signal according to the movement of the car 1. As the car operation detector 24, for example, an encoder, a resolver, a tachogenerator, or the like is used. The slip detection means of the second embodiment includes the drive sheave rotation detector 11, the car operation detector 24, and the slip detection circuit 30.

Generally, there is little difference between a tension of the main rope 3 on one side of the deflector sheave 10 and a tension of the main rope 3 on the other side of the deflector sheave 10, and hence the slip does not occur between the deflector sheave 10 and the main rope 3. Therefore, even if the car operation detector 24 is provided to the deflector sheave 10 to compare the signal from the drive sheave rotation detector 11 and a signal from the car operation detector 24 with each other, the slip between the drive sheave 5 and the main rope 3 can be detected. Moreover, in comparison with the first embodiment, a detection signal is less likely to be affected by a vibration of the car 1. Therefore, the movement of the main rope 3 can be more precisely identified.

Although the car operation detector 24 is provided to the deflector sheave 10 in the second embodiment, the car operation detector 24 may be provided to any sheaves or pulleys other than the deflector sheave 10, except for the drive sheave 5 around which the main rope 3 is looped. For example, in the case of an elevator having a 2:1 roping arrangement, the car operation detector can also be provided to a car suspension sheave, a car pulley, or the like.

Third Embodiment

Figure 6:
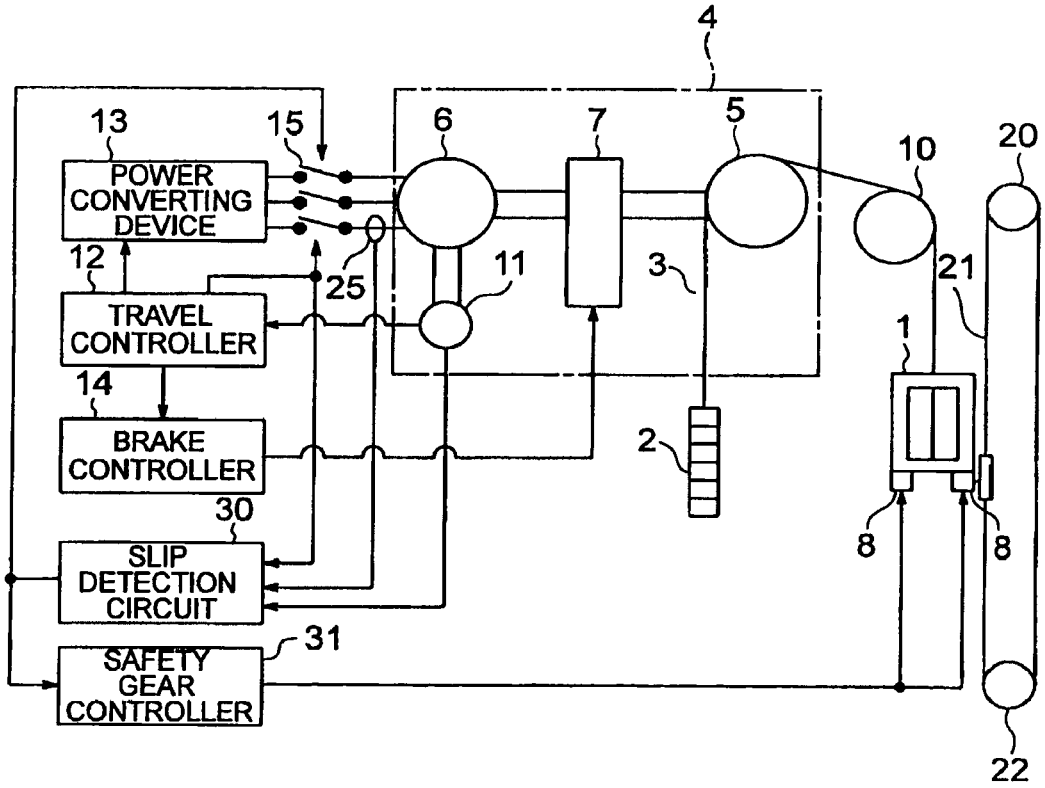
FIG. 6 is a configuration diagram illustrating an elevator apparatus according to a third embodiment of the present invention.

Next, FIG. 6 is a configuration diagram illustrating an elevator apparatus according to a third embodiment of the present invention. In this example, a current sensor 25 is provided to a power supply cable for the hoisting machine motor 6. The current sensor 25 generates a signal according to a torque of the hoisting machine motor 6. The slip detection circuit 30 judges the slip between the drive sheave 5 and the main rope 3 based on an open signal for the relay 15, specifically, the brake operation command, a signal from the current sensor 25, and the signal from the drive sheave rotation detector 11.

More specifically, when the open signal for the relay 15 (brake operation command) is issued, the movement of the drive sheave 5, that is, the output from the drive sheave rotation detector 11 is taken into particular consideration. When no slip occurs, the hoisting machine brake 7 effects braking while there exists an inertia of the hoisting machine 4, the car 1, the counterweight 2, and the main rope 3. However, when the slip occurs between the drive sheave 5 and the main rope 3 during the braking operation, the inertia of the car 1, the counterweight 2, and the main rope 3 is suddenly reduced. Therefore, the rotation speed of the drive sheave 5 is suddenly reduced.

Therefore, the slip detection circuit 30 judges the occurrence of the slip when a value of an acceleration signal obtained by converting the output of the drive sheave rotation detector 11 into an acceleration becomes larger than a predetermined deceleration (when a deceleration of the drive sheave 5 is equal to or larger than a predetermined value), and therefore, issues the safety gear operation command to the safety gear controller 31.

Moreover, during the normal running of the car 1 without the output of the open signal for the relay 15, the motor torque, specifically, the output from the current sensor 25 is taken into particular consideration. When no slip occurs, the hoisting machine motor 6 effects driving while there exists the inertia of the hoisting machine 4, the car 1, the counterweight 2, and the main rope 3. However, when the slip occurs between the drive sheave 5 and the main rope 3 during the normal running, the inertia of the car 1, the counterweight 2, and the main rope 3 is suddenly reduced. Therefore, the motor torque is suddenly reduced.

Therefore, the slip detection circuit 30 judges the occurrence of the slip when a rate of reduction of the motor torque, that is, a rate of reduction of the output from the current sensor 25 becomes larger than a predetermined value. Then, independently of the travel controller 12, the slip detection circuit 30 opens the relay 15 to cut the electricity of the hoisting machine motor 6. In addition, the slip detection circuit 30 issues the safety gear operation command to the safety gear controller 31. The slip detection means of the third embodiment includes the drive sheave rotation detector 11, the current sensor 25, and the slip detection circuit 30.

Even with the safety system for the elevator as described above, the car 1 can be immediately stopped upon detection of the rope slip, regardless of the state of the weight balance between the car 1 and the counterweight 2. Moreover, at least the slip occurring in normal running (driving) can be coped with by the current sensor 25. Therefore, as compared with the use of the encoder or the resolver, the cost is low.

Fourth Embodiment

Figure 7:
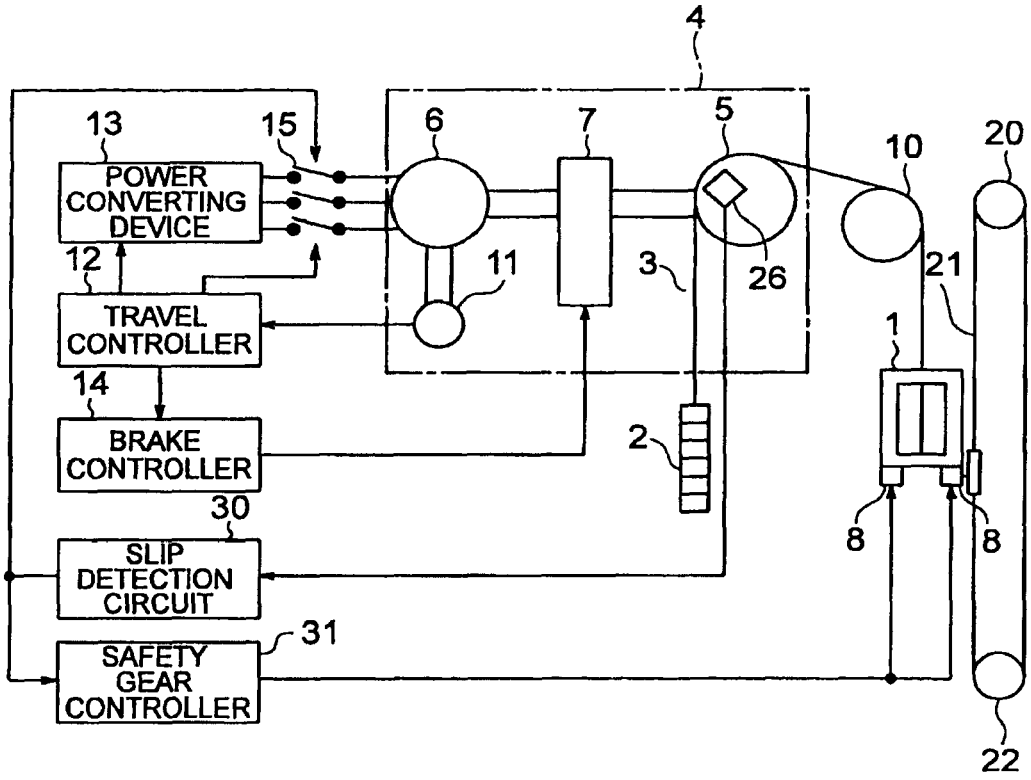
FIG. 7 is a configuration diagram illustrating an elevator apparatus according to a fourth embodiment of the present invention.

Next, FIG. 7 is a configuration diagram illustrating an elevator apparatus according to a fourth embodiment of the present invention. In the drawing, a signal from a temperature measuring device 26 is input to the slip detection circuit 30. The temperature measuring device 26 generates a signal according to a temperature at a surface of the drive sheave 5 and a surface of the main rope 3, which are brought into contact with each other. As the temperature measuring device 26, for example, a thermocouple embedded in the vicinity of a surface of a groove of the drive sheave 5, an infrared thermometer for measuring a temperature of the surface of the main rope 3 or a temperature of the surface of the groove of the drive sheave 5 in a non-contact manner, or the like is used.

When the temperature measured by the temperature measuring device 26 or a rate of change (rate of increase) in the temperature exceeds a predetermined value, the slip detection circuit 30 judges the occurrence of the slip between the drive sheave 5 and the main rope 3. Independently of the travel controller 12, the slip detection circuit 30 opens the relay 15 to cut the electricity to the hoisting machine motor 6. In addition, the slip detection circuit 30 issues the safety gear operation command to the safety gear controller 31. The slip detection means of the fourth embodiment includes the temperature measuring device 26 and the slip detection circuit 30.

In the safety system for the elevator as described above, the slip between the drive sheave 5 and the main rope 3 can be detected only by a single sensor, specifically, the temperature measuring device 26. Therefore, the number of components can be reduced.

The number, the material, and the sectional structure, or the like of the main rope 3 is not particularly limited. For example, any of a rope having a circular sectional shape and a belt-type rope may be used. Moreover, a resin-covered rope having an outer circumference covered with a resin may be used.

Moreover, the slip detection circuit 30 may be configured by a circuit for processing analog signals.

Further, although the slip detection circuit 30 may be configured to be integrated with the brake controller 14 or may be configured as a device independent of the travel controller 12, the latter configuration is suitable.

Further, a specific structure of the safety gears 8 is not limited to those of FIGS. 2 and 3 as long as the emergency stop can be made regardless of whether the running direction of the car 1 is upward or downward.

The invention claimed is:

1. A safety system for an elevator, comprising:

slip detection means for detecting a slip between a drive sheave and a main rope;

a safety gear mounted to a car, the safety gear being electrically operated by an actuator to cause the car to make an emergency stop regardless of whether a running direction of the car is upward or downward; and a safety gear controller for cutting power supply to a hoisting machine motor and causing the safety gear to make a braking operation upon detection of the slip between the drive sheave and the main rope by the slip detection means, wherein the slip detection means comprises a slip detection circuit for judging occurrence of the slip between the drive sheave and the main rope when a rate of reduction of a motor torque of the hoisting machine motor becomes larger than a predetermined value during normal running of the car.

* * * * *